US008657410B2

(12) United States Patent
Nakahashi et al.

(10) Patent No.: US 8,657,410 B2
(45) Date of Patent: Feb. 25, 2014

(54) LIQUID DISCHARGING NOZZLE AND METHOD FOR RECOVERING WATER-REPELLENT LAYER OF THE LIQUID DISCHARGING NOZZLE

(75) Inventors: Takahiro Nakahashi, Osaka (JP); Hiroyuki Hanato, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/562,578

(22) Filed: Jul. 31, 2012

(65) Prior Publication Data

US 2013/0033545 A1 Feb. 7, 2013

(30) Foreign Application Priority Data

Aug. 1, 2011 (JP) ..... 2011-168797

(51) Int. Cl.
*B41J 2/16* (2006.01)

(52) U.S. Cl.
CPC ..... *B41J 2/1606* (2013.01)
USPC ..... 347/45; 427/299

(58) Field of Classification Search
USPC ..... 347/45
See application file for complete search history.

(56) References Cited

U.S. PATENT DOCUMENTS

2002/0135636 A1* 9/2002 Miyakawa et al. ..... 347/45
2004/0070726 A1* 4/2004 Ishak ..... 351/163
2004/0253369 A1* 12/2004 Jallouli et al. ..... 427/162
2005/0001879 A1* 1/2005 Miyajima et al. ..... 347/45
2005/0012975 A1* 1/2005 George et al. ..... 359/223
2007/0236524 A1* 10/2007 Inoue et al. ..... 347/15
2008/0136866 A1* 6/2008 Okamura et al. ..... 347/45
2010/0053269 A1 3/2010 Fujii et al.
2010/0263725 A1* 10/2010 Schmidt ..... 136/261
2010/0317780 A1* 12/2010 Cheng et al. ..... 427/154

FOREIGN PATENT DOCUMENTS

JP 10297939 A * 11/1998
JP 2003-327909 A 11/2003
JP 2004-075739 A 3/2004
JP 2010-076422 A 4/2010

* cited by examiner

*Primary Examiner* — Shelby Fidler
(74) *Attorney, Agent, or Firm* — Nixon & Vanderhye P.C.

(57) ABSTRACT

A liquid discharging nozzle of the present invention includes (i) a liquid reservoir for reserving a discharging liquid and (ii) a discharging tube connected to a bottom part of the liquid reservoir. A water-repellent layer is provided on an inner surface of the discharging tube, on an inner surface of the discharging tube, and on an inner surface of the liquid reservoir, and is a fluorinated water-repellent layer. An aluminum oxide layer and a silicon oxide layer are used as foundation layers of the fluorinated water-repellent layer. The aluminum oxide layer, the silicon oxide layer, and the fluorinated water-repellent layer, which are stacked together, have a combined thickness of not more than 25 nm. The fluorinated water-repellent layer alone has a thickness of 1 nm to 4 nm.

6 Claims, 5 Drawing Sheets

TAPERED TYPE

TAPERED AND STRAIGHT TYPE

TAPERED, STEPPED, AND STRAIGHT TYPE

LIQUID DISCHARGING NOZZLE AND METHOD FOR RECOVERING WATER-REPELLENT LAYER OF THE LIQUID DISCHARGING NOZZLE

This Nonprovisional application claims priority under 35 U.S.C. §119 on Patent Application No. 2011-168797 filed in Japan on Aug. 1, 2011, the entire contents of which are hereby incorporated by reference.

TECHNICAL FIELD

The present invention relates to a liquid discharging nozzle and to a method for recovering a water-repellent layer of the liquid discharging nozzle.

BACKGROUND ART

Conventionally, when a liquid is dispensed by use of a liquid discharge regulator, the liquid is discharged, for example, via a nozzle of the dispenser. Note that a nozzle is typically made of a non-corrosive metal such as stainless. As a common way of preventing liquid drops from obstructing a discharging head of a nozzle, a water-repellent film is formed at the nozzle.

When a nozzle, which is made of a non-corrosive metal such as stainless steel, is continuously used without proper maintenance and, as a result, when a water-repellent film formed on a nozzle starts to come off, a liquid becomes likely to remain at a discharging head of the nozzle. This causes, when the liquid is dispensed as drops, (i) the size of a first drop to become large and therefore (ii) the overall amount and forms of the drops to be inconsistent. This phenomenon becomes particularly problematic in cases where a liquid is dispensed for (a) an attachment of an LED sealant containing a fluorescent material and (b) an attachment of a camera module requiring precision in the area of combining surfaces.

As a method for preventing a liquid from obstructing a discharging head of a nozzle as described above, there is a method in which a depressurizing mechanism called a suction bag is attached to a liquid discharge regulator so as to retrieve a liquid obstructing a discharging head of a nozzle. However, even a suction bag is incapable of sufficiently removing a liquid that is remaining at/obstructing a discharging head of a nozzle. Hence, continuous use of a liquid discharging nozzle inevitably leads to inconsistency in the amount and forms of liquids because liquids eventually remain at/obstruct a discharging head of the nozzle as a result of (i) stains becoming, over time, collected on even a water-repellent film or (ii) the water-repellent film physically coming off because of particles contained in the liquids. Note that the chance of the liquids obstructing the discharging head varies, depending on (a) how rough surfaces of inner and outer walls of the nozzle are and (b) the thickness of the walls at the discharging head. Therefore, there are nozzles made of non-metal materials such as ruby and ceramic in order to enhance processing details of the nozzles. These types of non-metal nozzles, however, are highly expensive. Thus, there is a demand for a technology that could carry out liquid discharge with consistency in a discharging amount while maintaining low costs.

Examples of liquid discharging heads (disclosed in Patent Literatures 1 through 3) for solving the problem encompass a nozzle 100. The nozzle 100 is made up of, for durability of a water-repellent film, (i) a nozzle plate 101, (ii) a foundation layer 102 provided on a surface of the nozzle plate 101, and (iii) (a) a plated film prepared by adding fluorine to a surface of the foundation layer 102 or (b) an organic water-repellent film 103 (see FIG. 5). Also, there are other disclosed technologies in which surfaces of nozzle plates are coated with fluorinated and silicon-based water repellents.

CITATION LIST

Patent Literatures

Patent Literature 1
Japanese Patent Application Publication, Tokukai, No. 2004-75739 A (Publication Date: Mar. 11, 2004)
Patent Literature 2
Japanese Patent Application Publication, Tokukai, No. 2003-327909 A (Publication Date: Nov. 19, 2003)
Patent Literature 3
Japanese Patent Application Publication, Tokukai, No. 2010-76422 A (Publication Date: Apr. 8, 2010)

SUMMARY OF INVENTION

Technical Problem

However, with the conventional liquid discharging heads, the same problem still persists: continuous use of the nozzles for discharging liquids inevitably leads to inconsistency in the amount and forms of liquids because the liquids remain at/obstruct the discharging heads of the nozzles as a result of (i) stains becoming, over time, collected on even the water-repellent films or (ii) the water-repellent films physically coming off because of particles contained in the liquids. Furthermore, in a case where liquids are solidified on the water-repellent films or where differing substances become stuck on the water-repellent films, such liquids/substances are difficult to remove. Consequently, liquids end up remaining at the discharging heads of the nozzles.

Additionally, the conventional liquid discharging heads each have another problem that the liquid discharging head easily clogs up in a case where (i) a discharging liquid is, instead of watery ink such as those used in the inkjet method, resin which is more viscous than the ink and (ii) a wetted area of the liquid discharging head is large.

The present invention has been made in view of the problems, and it is an object of the present invention to provide (i) a liquid discharging nozzle that can be used for an extended period of time as a result of being arranged such that (a) the nozzle is prevented from clogging up and (b) a water-repellent layer can easily be recovered even in a case where the water-repellent layer comes off or where substances become stuck on the water-repellent layer and (ii) a method for recovering the water-repellent layer of the liquid discharging nozzle.

Solution to Problem

In order to attain the object, a liquid discharging nozzle of the present invention includes: a liquid reservoir for reserving a discharging liquid; and a discharging section connected to a bottom part of the liquid reservoir, the discharging section having a discharging head and an inner wall, and the liquid reservoir having an inner wall, the discharging head of the discharging section, the inner wall of the discharging section, and the inner wall of the liquid reservoir, together having a water-repellent layer provided thereon, the water-repellent layer being a fluorinated water-repellent layer, the fluorinated water-repellent layer being provided on a foundation layer in which an aluminum oxide layer and a silicon oxide layer are stacked, the aluminum oxide layer, the silicon oxide layer, and the fluorinated water-repellent layer, together having a combined thickness of not more than 25 nm, and the fluorinated water-repellent layer having a thickness of 1 nm to 4 nm.

The liquid discharging nozzle of the present invention includes (i) the liquid reservoir for reserving a discharging liquid and (ii) the discharging tube connected to the bottom part of the liquid reservoir. The water-repellent layer is provided on the inner surface of the discharging tube, on the inner surface of the discharging tube, and on the inner surface of the liquid reservoir, and is a fluorinated water-repellent layer. The aluminum oxide layer and the silicon oxide layer are used as foundation layers of the fluorinated water-repellent layer.

According to a conventional general liquid discharging nozzle, a water-repellent layer is provided on a discharging head of a discharging section, but not on an inner surface of the discharging section. This is because (i) a problem of a liquid remaining in a nozzle fundamentally occurs at a discharging head from which the liquid is discharged and (ii) since a liquid generally flows fast on the inner surface, a water-repellent layer provided on the inner surface is prone to come off.

On the other hand, according to the present invention, the water-repellent layer is provided also on the inner surface of the discharging section and on the inner surface of the liquid reservoir. This is because, with such a configuration, the following advantage can be obtained: in a case where a discharging liquid is resin which is more viscous than watery ink such as those used in the inkjet method, a wetted area of the resin decreases as a surface tension of the inner surface of the discharging section is increased This causes a reduction in surface adhesion and friction between the inner surface and the resin. As such, the resin flows more smoothly.

According to the present invention, the water-repellent layer is thus provided on the inner surface of the discharging section and on the inner surface of the liquid reservoir. This brings about such an advantage that even a highly viscous liquid would flow smoothly inside a liquid discharging nozzle.

Nevertheless, there still remains a problem that the water-repellent layer can easily be removed from the inner surface by particles contained in a liquid or can easily be removed from the inner surface in a case where the flow of the liquid is fast.

In order to address such a remaining problem, the present invention is configured so that the foundation layer, in which the aluminum oxide layer and the silicon oxide layer are stacked, is provided under the water-repellent layer. This causes the water-repellent layer to be more firmly attached to the inner surface so that the water-repellent layer is not easily removed (i.e. durability is improved). According to the present invention, the aluminum oxide layer, the silicon oxide layer, and the fluorinated water-repellent layer are stacked together so as to have a combined thickness of not more than 25 nm, and the fluorinated water-repellent layer alone has a thickness of 1 to 4 nm.

Note that, according to some conventional liquid discharging nozzles, water-repellent layers have a thickness of approximately 100 μm so as to durability, in a case where Teflon (trademark) coating is employed in which the dipping treatment is carried out. However, in a case where, for example, a water-repellent layer having a total thickness of approximately 100 μm is provided on an inner surface of a discharging tube, the inner diameter of the discharging section is subject to significant change. This causes a significant fluctuation in film thickness. As such, an inner shape of the liquid discharging nozzle is adversely affected, and the amount of a discharging liquid is also adversely affected.

In view of the circumstances, according to the present invention, the aluminum oxide layer, the silicon oxide layer, and the fluorinated water-repellent layer are arranged to have a combined thickness of not more than 25 nm.

With the arrangement, the inner diameter of the discharging section is no longer subject to significant change even in a case where, as a result of continuous use of the liquid discharging nozzle for an extended period of time, (i) stains become collected over time on even the water-repellent layer or (ii) the water-repellent layer physically comes off because of particles in the liquids.

Additionally, according to the present invention, the fluorinated water-repellent layer is arranged to have a thickness of 1 nm to 4 nm. Since the thickness of the water-repellent layer is thus thin, the following advantage can be obtained: even in a case where (i) part of the water-repellent layer comes off, (ii) a liquid becomes solidified on the water-repellent layer, or (iii) differing substances adheres to the water-repellent layer, it is possible to provide a new water-repellent layer again because the water-repellent layer and, as needed, the substances adhered to the water-repellent layer can be easily removed by employing the plasma treatment.

Since the water-repellent layer can be thus easily recovered, it is possible to extend a life span of a liquid discharging nozzle.

Therefore, (i) even in a case of a highly viscous liquid, it is possible to prevent the nozzle from clogging up by making the highly viscous liquid have good fluidity and (ii) the water-repellent layer can be easily recovered even in the case where the water-repellent layer comes off or where substances adhere to the water-repellent layer. This makes it possible to provide a liquid discharging nozzle that can be used for an extended period of time.

In order to attain the object, a method for recovering the liquid discharging nozzle of the present invention includes the steps of: (i) removing the water-repellent layer and substances adhered to the water-repellent layer, which removing is carried out by use of at least one of plasma treatment, ultraviolet ray irradiation, and alkaline wash; and (ii) forming a water-repellent layer again after the step (i).

Specifically, in a case where, due to the repeated use of the liquid discharging nozzle, (i) part of the water-repellent layer is removed, (ii) a liquid is solidified on the water-repellent layer, or (iii) differing substances are adhered to the water-repellent layer, the water-repellent layer and the substances can easily be removed and eliminated by breaking a chemical bond with the use of at least one of the following: physical machine processing, plasma treatment, ultraviolet ray irradiation, and alkaline wash. In addition, since the thickness of the water-repellent layer is as thin as 1 nm to 4 nm, the water-repellent layer can easily be applied and formed again.

Therefore, (i) even in a case of a highly viscous liquid, it is possible to prevent the nozzle from clogging up by making the highly viscous liquid have good fluidity and (ii) the water-repellent layer can be easily recovered even in the case where the water-repellent layer comes off or where substances adhere to the water-repellent layer. This makes it possible to provide a liquid discharging nozzle that can be used for an extended period of time.

Advantageous Effects of Invention

A liquid discharging nozzle of the present invention includes: a liquid reservoir for reserving a discharging liquid; and a discharging section connected to a bottom part of the liquid reservoir, the discharging section having a discharging head and an inner wall, and the liquid reservoir having an inner wall, the discharging head of the discharging section, the inner wall of the discharging section, and the inner wall of the liquid reservoir, together having a water-repellent layer provided thereon, the water-repellent layer being a fluorinated water-repellent layer, the fluorinated water-repellent layer being provided on a foundation layer in which an aluminum oxide layer and a silicon oxide layer are stacked, the aluminum oxide layer, the silicon oxide layer, and the fluorinated water-repellent layer, together having a combined thickness of not more than 25 nm, and the fluorinated water-repellent layer having a thickness of 1 nm to 4 nm.

Also, a method of the present invention for recovering a water-repellent layer of a liquid discharging nozzle includes the steps of: (i) removing the water-repellent layer and substances adhered to the water-repellent layer, which removing is carried out by use of at least one of plasma treatment, ultraviolet ray irradiation, and alkaline wash; and (ii) forming a water-repellent layer again after the step (i).

Therefore, (i) even in a case of a highly viscous liquid, it is possible to prevent the nozzle from clogging up by making the highly viscous liquid have good fluidity and (ii) the water-repellent layer can be easily recovered even in the case where the water-repellent layer comes off or where substances adhere to the water-repellent layer. This makes it possible to provide a liquid discharging nozzle that can be used for an extended period of time.

BRIEF DESCRIPTION OF DRAWINGS

FIG. 1(*b*) is a cross-sectional view illustrating a discharging head of the discharging tube, an inner surface of the discharging tube, and an inner surface of the liquid reservoir.

FIG. 2(*b*) is a bottom view illustrating the configuration of the liquid discharging nozzle.

FIG. 3(*b*) is a cross-sectional view illustrating a liquid discharging nozzle of a tapered and straight type.

FIG. 3(*c*) is a cross-sectional view illustrating a liquid discharging nozzle of a tapered, stepped, and straight type.

DESCRIPTION OF EMBODIMENTS

Figure 1:
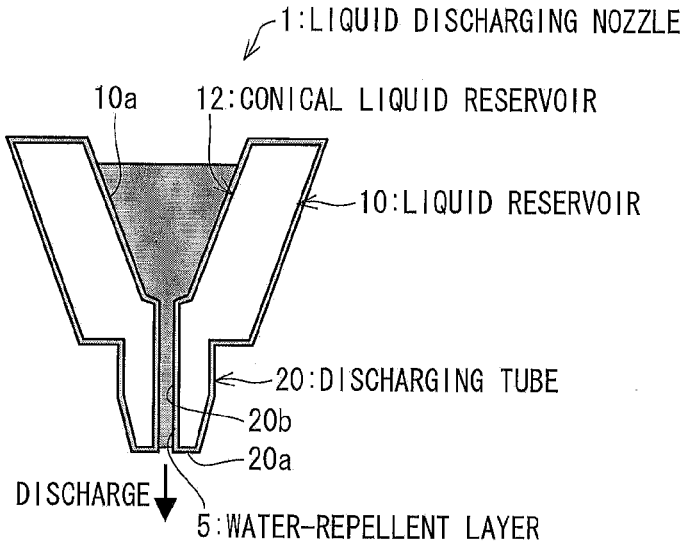
FIG. 1(*a*) is for illustrating an embodiment of a liquid discharging nozzle of the present invention and is a cross-sectional view illustrating a configuration of a liquid discharging nozzle including a conical liquid reservoir and a discharging tube.
Figure 1:
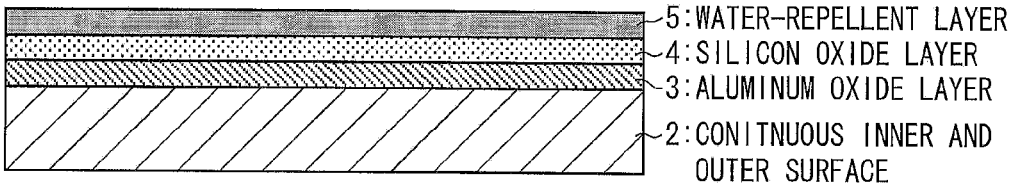

The following description will discuss, with reference to FIGS. 1(*a*) through 4, an embodiment of the present invention.

(Configuration of Liquid Discharging Nozzle)

Figure 2:
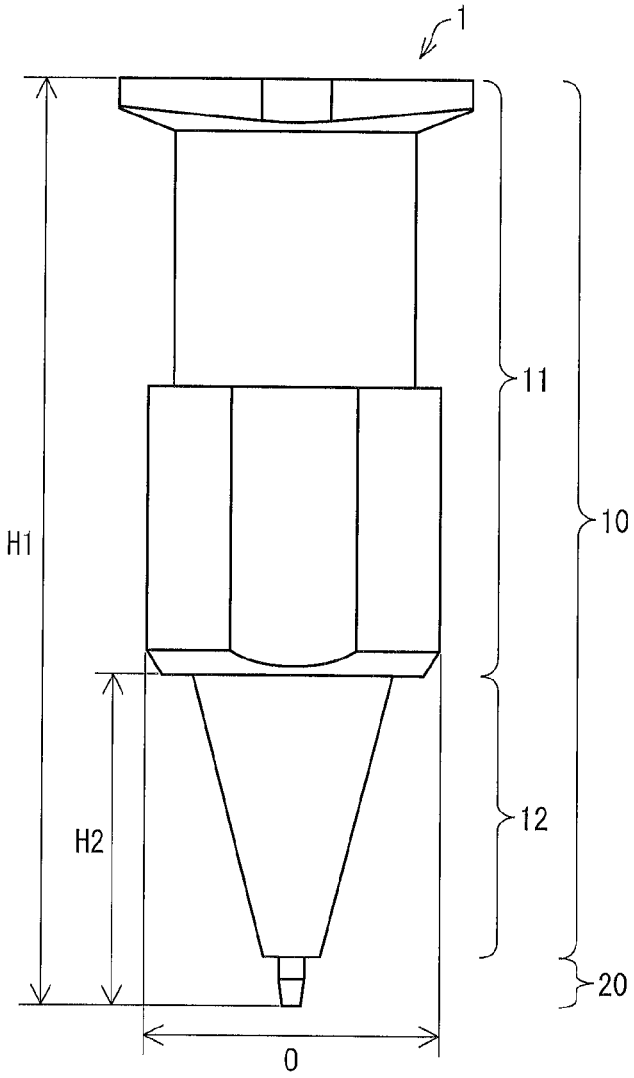
FIG. 2(*a*) is a front view illustrating the configuration of the liquid discharging nozzle.
Figure 2:
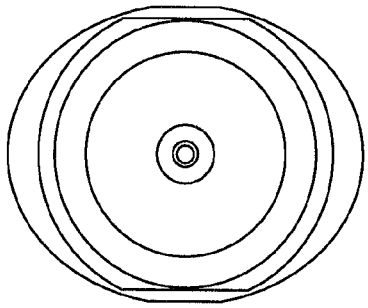

A configuration of a liquid discharging nozzle 1 of the present embodiment will be described below with reference to FIG. 1(*a*), FIG. 1(*b*), FIG. 2(*a*), and FIG. 2(*b*). FIG. 1(*a*) is a cross-sectional view illustrating the configuration of the liquid discharging nozzle 1 including (i) a conical liquid reservoir having a conical form and (ii) a discharging tube. FIG. 1(*b*) is a cross-sectional view illustrating a water-repellent layer provided on each of a discharging head of the discharging tube, an inner wall surface of the discharging tube, and an inner wall surface of the liquid reservoir. FIG. 2(*a*) is a front view illustrating the configuration of the liquid discharging nozzle. FIG. 2(*b*) is a bottom view illustrating the configuration of the liquid discharging nozzle.

The liquid discharging nozzle 1 of the present embodiment is, for example, for applying a fluorescent material resin for an LED (Light-Emitting Diode). As illustrated in FIGS. 2(*a*) and 2(*b*), the liquid discharging nozzle 1 includes (i) a liquid reservoir 10 for reserving a discharging liquid and (ii) a discharging tube 20 connected to the bottom of the liquid reservoir 10.

The liquid reservoir 10 is made up of a cylindrical liquid reservoir 11 (top) and a conical liquid reservoir 12 (bottom).

The cylindrical liquid reservoir 11 and the discharging tube (discharging section) 20 are built so as to each have a circular cross section, which matches a corresponding circular cross section of the conical liquid reservoir 12. However, the cross section of the entire liquid discharging nozzle 1 is not limited to a circular shape, and can therefore be, for example, a polygonal shape.

The liquid discharging nozzle 1 has a height (H1) of, for example, 18 mm, and the conical liquid reservoir 12 and the discharging tube 20 have a combined height (H2) of, for example, 6.5 mm. The cylindrical liquid reservoir 11 has an outer diameter of, for example, 6 mm. The cylindrical liquid reservoir 11 has, either on its front or back side, a flat surface provided, and the flat surface has, for example, an amount of discharging liquid marked.

A bottom part of the conical liquid reservoir 12 is connected to the discharging tube 20, and the discharging tube 20 has an inner diameter smaller than that of the conical liquid reservoir 12 (see FIG. 1(*a*)).

According to the liquid discharging nozzle 1, a water-repellent layer 5 is provided on a continuous inner and outer wall surface 2 of (i) the conical liquid reservoir 12 and (ii) the discharging tube 20 (see FIG. 1(*b*)). Note that, according to the present invention, the water-repellent layer 5 should be provided at least on (A) a discharging head 20*a* of the discharging tube 20, (B) an inner wall surface 20*b* of the discharging tube 20, and (C) an inner wall surface 10*a* of the liquid reservoir 10.

Specifically, the water-repellent layer 5, which is provided on the continuous inner and outer surface 2, is made of a fluorinated water-repellent material. Provided as a foundation layer of the water-repellent layer 5 is a stacked configuration in which (i) an aluminum oxide ($Al_2O_3$) layer 3 serving as a foundation layer and (ii) a silicon oxide ($SiO_2$) layer 4 serving as a foundation layer are stacked in this order.

Note that, according to the liquid discharging nozzle 1 of the present embodiment, the water-repellent layer 5 is provided on the continuous inner and outer surface 2. The present invention is, however, not limited to such an arrangement, provided that the water-repellent layer 5 is provided at least on a continuous inner surface of the conical liquid reservoir 12 and of the discharging tube 20.

According to the present embodiment, (i) the water-repellent layer 5 has a thickness of 1 nm to 4 nm and (ii) even the combination of the three layers (i.e. the water-repellent layer 5, the aluminum oxide ($Al_2O_3$) layer 3, and the silicon oxide ($SiO_2$) layer 4) has a thickness of not more than 25 nm (preferably not more than 20 nm). This is because of the following reason. In a case where the combination of the three layers has a thickness of more than 25 nm, the inner diameter of the discharging tube 20 becomes changed after the discharging tube 20 is used for an extended period of time. This causes a change in the shape of the discharging tube 20. A prototype of the liquid discharging nozzle 1 was prepared, and the specific measure of the thickness of each layer was as follows: the aluminum oxide ($Al_2O_3$) layer 3-10.5 nm; the silicon oxide ($SiO_2$) layer 4-6.5 nm; and the water-repellent layer 5 made of a fluorinated water-repellent material—1.2 nm.

(Method for Forming Water-Repellent Layer of Liquid Discharging Nozzle)

The following description will discuss a method for forming the water-repellent layer 5 of the liquid discharging nozzle 1 configured as described above.

According to the present embodiment, the aluminum oxide ($Al_2O_3$) layer 3 and the silicon oxide ($SiO_2$) layer 4 are stacked in this order so as to form a foundation layer on the continuous inner and outer surface 2. Then, a fluorinated water-repellent layer (self-assembled monomolecular layer) is formed on the foundation layer. This (i) causes the total thickness of the three layers combined to be approximately 20 nm and therefore (ii) causes the inner shape of the discharging tube 20 not to be adversely affected.

First, (i) the liquid discharging nozzle 1 is placed in a chamber by use of the vapor deposition by which organic molecules are deposited and then (ii) the continuous inner and outer surface 2 of the liquid discharging nozzle 1 are cleaned by use of oxygen plasmas so as to be activated. Next, reactive gas is heated up to 100° C. so as to be vaporized, and is then introduced into the chamber, which has been preheated up to 55° C., so that the aluminum oxide ($Al_2O_3$) layer 3 is formed on the inner and outer surfaces 2 of the liquid discharging nozzle 1 in the chamber. Thereafter, inside of the chamber is depressurized until the air pressure there falls in the range of 3 Pa to 8 Pa. By repeating this cycle, the aluminum oxide ($Al_2O_3$) layer 3 having a thickness of approximately 10 nm is formed.

Subsequently, in the chamber, a top surface of the aluminum oxide ($Al_2O_3$) layer 3 is cleaned by use of oxygen plasmas so as to be activated. Next, reactive gas is heated up to 100° C. so as to be vaporized, and is then introduced into the chamber, which has been preheated up to 55° C., so that the silicon oxide ($SiO_2$) layer 4 is formed on the aluminum oxide ($Al_2O_3$) layer 3. Thereafter, inside of the chamber is depressurized until the air pressure there falls in the range of 3 Pa to 8 Pa. By repeating this cycle, the silicon oxide ($SiO_2$) layer 4 having a thickness of approximately 10 nm is formed.

Then, a fluorinated water-repellent film, which is a monomolecular film having a thickness of approximately 1 nm to 4 nm, is formed all over a top surface of the silicon oxide ($SiO_2$) layer 4.

(Method for Recovering Water-Repellent Layer of Liquid Discharging Nozzle)

Generally, the water-repellent layer 5 of the liquid discharging nozzle 1 is highly effective in repelling water, but not so in repelling oil. The water repellency is not permanently maintained but will deteriorate as liquid discharge is repeated again and again. This is because the repeated liquid discharging causes residues. The residues unfortunately cannot be completely removed even (i) by cleaning with the use of organic solvent such as acetone or (ii) by ultrasonic cleaning with the use of isopropyl alcohol etc. In view of the circumstances, the residues are removed along with the water-repellent layer by oxygen plasmas so that only the fluorinated water-repellent layer, which is formed as the top layer on the inner and outer surface 2, is removed. This causes the foundation layer, namely, the silicon oxide ($SiO_2$) layer 4 to be exposed. In a state where the silicon oxide ($SiO_2$) layer 4 is thus cleaned, a new fluorinated water-repellent layer is formed on the silicon oxide ($SiO_2$) layer 4.

As described above, the liquid discharging nozzle 1 of the present embodiment includes (i) the liquid reservoir 10 for reserving a discharging liquid and (ii) the discharging tube 20 connected to the bottom of the liquid reservoir 10. The water-repellent layer 5 is formed on (A) the discharging head 20*a* of the discharging tube 20, (B) the inner wall surface 20*b* of the discharging tube 20, and (C) the inner wall surface 10*a* of the liquid reservoir 10. The water-repellent layer 5 is a fluorinated water-repellent layer. Provided as a foundation layer of the fluorinated water-repellent layer 5 is a stacked configuration in which (i) an aluminum oxide ($Al_2O_3$) layer 3 serving as a foundation layer and (ii) a silicon oxide ($SiO_2$) layer 4 serving as a foundation layer are stacked in this order.

According to a conventional general liquid discharging nozzle, a water-repellent layer is formed on a discharging head of a discharging tube, but not on an inner surface of the discharging tube. This is because (i) a problem of a liquid remaining in a nozzle fundamentally occurs at a discharging head from which the liquid is discharged and (ii) since a liquid generally flows fast on the inner surface, a water-repellent layer formed on the inner surface is prone to come off.

On the other hand, according to the present embodiment, the water-repellent layer 5 is formed also on the inner surface 20*b* of the discharging tube 20 and on the inner surface 10*a* of the liquid reservoir 10. This is because, with the configuration, the following advantage can be obtained: in a case where a discharging liquid is resin which is more viscous than watery ink such as those used in the inkjet method, a wetted area of the resin decreases as a surface tension of the inner surface 20*b* of the discharging tube 20 is increased. This causes a reduction in surface adhesion and friction between the inner surface 20*b* and the resin. As such, the resin flows more smoothly.

According to the present embodiment, the water-repellent layer 5 is thus formed on the inner surface 20*b* of the discharging tube 20 and on the inner surface 10*a* of the liquid reservoir 10. This brings about such an advantage that even a highly viscous liquid would flow smoothly inside the liquid discharging nozzle 1.

Nevertheless, there still remains a problem that the water-repellent layer 5 can easily be removed from the inner surface 20*b* by particles in a liquid or can easily be removed from the inner surface 20*b* in a case where the flow of the liquid is fast.

In order to address such a remaining problem, the present embodiment is configured so that the foundation layer, in which the aluminum oxide ($Al_2O_3$) layer 3 and the silicon oxide ($SiO_2$) layer 4 are stacked, is formed under the water-repellent layer 5. This causes the water-repellent layer 5 to be more firmly attached to the inner surface 20*b*, so that the water-repellent layer 5 is not easily removed (i.e. durability is improved).

Furthermore, according to the present embodiment, (a) the aluminum oxide ($Al_2O_3$) layer 3, the silicon oxide ($SiO_2$) layer 4, and the fluorinated water-repellent layer are stacked together so as to have a combined thickness of not more than 25 nm and (b) the fluorinated water-repellent layer alone has a thickness of 1 nm to 4 nm. Note that (i) it is difficult to form a fluorinated water-repellent layer so that a monomolecular film has a thickness of less than 1 nm and (ii) if the thickness is more than 4 nm, then a layer, in which the molecular chains are intertwined, becomes thick as with the thick layer of Patent Literature 3. This causes fluorinated water-repellent layer to become prone to come off. It is not therefore preferable that the thickness is more than 4 nm.

Note that, according to some conventional liquid discharging nozzles, water-repellent layers have a thickness of approximately 100 μm so as to increase durability, in a case where Teflon (trademark) coating is employed in which the dipping treatment is carried out. However, in a case where, for example, a water-repellent layer having a total thickness of approximately 100 μm is formed on an inner surface of a discharging tube, the inner diameter of the discharging tube is subject to significant change. This causes a significant fluctuation in film thickness. As such, an inner shape of the liquid discharging nozzle is adversely affected, and the amount of a discharging liquid is also adversely affected.

In view of the circumstances, according to the present embodiment, the aluminum oxide ($Al_2O_3$) layer 3, the silicon oxide ($SiO_2$) layer 4, and the fluorinated water-repellent layer are arranged to have a combined thickness of not more than 25 nm.

With the arrangement, the inner diameter of the discharging tube 20 is no longer subject to significant change even in a case where, as a result of continuous use of the liquid discharging nozzle 1 for an extended period of time, (i) stains become collected over time on even the water-repellent layer 5 or (ii) the water-repellent layer 5 physically comes off because of particles in the liquids.

Additionally, according to the present embodiment, the fluorinated water-repellent layer 5 is arranged to have a thickness of 1 nm to 4 nm. Since the thickness of the water-repellent layer 5 is thus thin, the following advantage can be obtained: even in a case where (i) part of the water-repellent layer 5 comes off, (ii) a liquid becomes solidified on the water-repellent layer 5, or (iii) differing substances adheres to the water-repellent layer 5, it is possible to form a new water-repellent layer 5 again because the water-repellent layer 5 and, as needed, the substances adhered to the water-repellent layer 5 can be easily removed by employing a plasma treatment.

Since the water-repellent layer 5 can be thus easily recovered, it is possible to extend a life span of the liquid discharging nozzle 1.

Therefore, (i) even in a case of a highly viscous liquid, it is possible to prevent the nozzle from clogging up by making the highly viscous liquid have good fluidity and (ii) the water-repellent layer 5 can be easily recovered even in the case where the water-repellent layer 5 comes off or where substances adhere to the water-repellent layer 5. This makes it possible to provide a liquid discharging nozzle 1 that can be used for an extended period of time.

Moreover, according to the liquid discharging nozzle 1 of the present embodiment, a discharging liquid is a resin material. Since a resin material is more viscous than ink, it is possible to obtain even a greater effect of the present embodiment by employing the resin material as a discharging medium of the liquid discharging nozzle 1.

Furthermore, according to the method for recovering the water-repellent layer 5 of the liquid discharging nozzle 1 of the present invention, a new water-repellent layer 5 is formed again after removing substances adhered to the water-repellent layer 5 and the water-repellent layer 5 itself by use of at least one of the following: plasma treatment, ultraviolet ray irradiation, and alkaline wash.

Specifically, in a case where, due to the repeated use of the liquid discharging nozzle 1, (i) part of the water-repellent layer 5 is removed, (ii) a liquid is solidified on the water-repellent layer 5, or (iii) differing substances are adhered to the water-repellent layer 5, the water-repellent layer 5 and the substances can easily be removed and eliminated by breaking a chemical bond with the use of at least one of the following: physical machine processing, plasma treatment, ultraviolet ray irradiation, and alkaline wash. In addition, since the thickness of the water-repellent layer 5 is as thin as 1 nm to 4 nm, the water-repellent layer 5 can easily be applied and formed again.

Note that examples of plasma treatment as a method for removing objects such as the water-repellent layer 5 encompass the oxygen plasma treatment and the argon plasma treatment. Also, examples of ultraviolet ray irradiation encompass oxygen treatment. It is possible to thus employ, in order to remove the water-repellent layer 5, physical machine processing and/or a chemical removal method.

Also note that, out of the various methods for removing the water-repellent layer 5, the argon plasma treatment and the oxygen plasma treatment are preferable, and the oxygen plasma treatment is most preferable. This is because of the following reasons. Namely, in a case where the water-repellent layer 5 and the like are formed, film formations are carried out in a vacuum chamber. As such, both the argon plasma treatment and the oxygen plasma treatment can be carried out in the same chamber in which the water-repellent layer 5 and the like have been formed. It follows that the liquid discharging nozzle 1, on which the water-repellent layer 5 and the like are to be formed, does not need to be exposed to the air halfway. This means that the water-repellent layer 5 and the like have no chance of being adhered by floating matters in the air. This allows the film formations to be made while a clean condition is being maintained. Note that the oxygen plasma treatment is more widely used and costs less than the argon plasma treatment.

As described above, only the fluorinated water-repellent layer 5 is removed, after deteriorating as a result of repetitive liquid discharge, with the use of the oxygen plasma treatment. This exposes the silicon oxide ($SiO_2$) layer 4 which is a foundation layer of the water-repellent layer 5. It is therefore possible to form a new fluorinated water-repellent layer.

It is therefore possible to provide a method for recovering a water-repellent layer 5 in the liquid discharging nozzle 1 that can be used for an extended period of time, by (i) preventing the liquid discharging nozzle 1 from clogging up and (ii) easily recovering the water-repellent layer 5 even in a case where the water-repellent layer 5 comes off or where substances are adhered to the water-repellent layer 5.

Note that the present invention is not limited to the embodiment, and can therefore be altered in many ways by a person skilled in the art within the scope of the present invention. For example, in the embodiment, the form of the bottom part (discharging section) of the liquid discharging nozzle 1 is cylindrical (as is the form of the discharging tube 20), but is not necessarily limited to such: the liquid discharging nozzle 1 can be applied to each type of liquid discharging nozzle illustrated in FIG. 3(*a*), FIG. 3(*b*), and FIG. 3(*c*).

Figure 3:
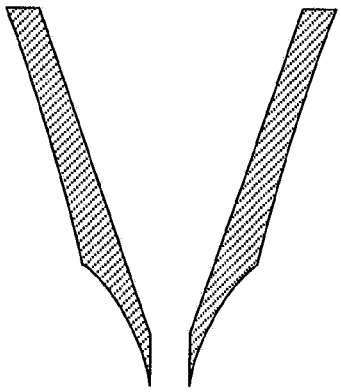
FIG. 3(*a*) is a cross-sectional view illustrating a liquid discharging nozzle of a tapered type.
Figure 3:
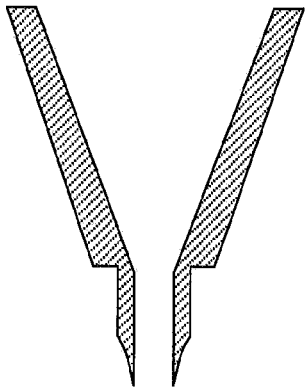
Figure 3:
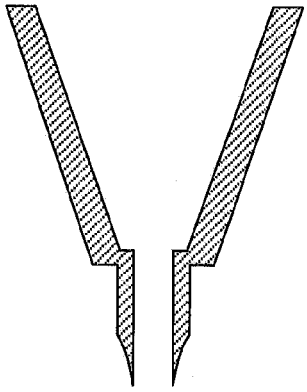

A liquid discharging nozzle 1 illustrated in FIG. 3(*a*) is of a tapered type. This liquid discharging nozzle 1 has a discharging section tapered so that (i) the flow of a liquid during discharge becomes enhanced and (ii) the flowing speed is maintained without being adversely affected by inner pipe resistance. This type of liquid discharging nozzle 1 can cause a small inner pipe resistance, but such a small inner pipe resistance causes a discharging liquid to be unstable, so as to adversely affect the flowing speed of the liquid. This hinders consistent amount of discharging liquid.

A liquid discharging nozzle 1 illustrated in FIG. 3(*b*) is of a tapered and straight type. This type of liquid discharging nozzle 1 has a straight discharging section. Although an upper part of the nozzle has a tapered form and therefore enhances the flowing speed of a liquid, the liquid is slowed down by inner pipe resistance caused by the straight-formed discharging section, so that the flowing speed becomes constant and stable. This type of liquid discharging nozzle 1 has a high inner pipe resistance and yet allows for a consistent amount of liquid discharge.

A liquid discharging nozzle 1 illustrated in FIG. 3(*c*) is the one described in the present embodiment, and is of a tapered, stepped, and straight type. According to this type of liquid discharging nozzle 1, (i) an upper part having a tapered form enhances the flow of a liquid, (ii) a step causes retention of the liquid so as to slow down the flowing speed of the liquid, and (iii) a straight-formed discharging section causes an inner pipe resistance so as to further slow down the flowing speed of the liquid. This type of liquid discharging nozzle 1 causes the overall flow of a liquid to be slowed down, and therefore results in accelerated solidification of the liquid.

Although the description has discussed the case where the liquid discharging nozzle 1 of the present embodiment is employed to apply a fluorescent material resin for an LED (Light-Emitting Diode), the liquid discharging nozzle 1 of the present embodiment is not necessarily limited to such, and can therefore be applied to a wide variety of liquid materials.

Figure 4:
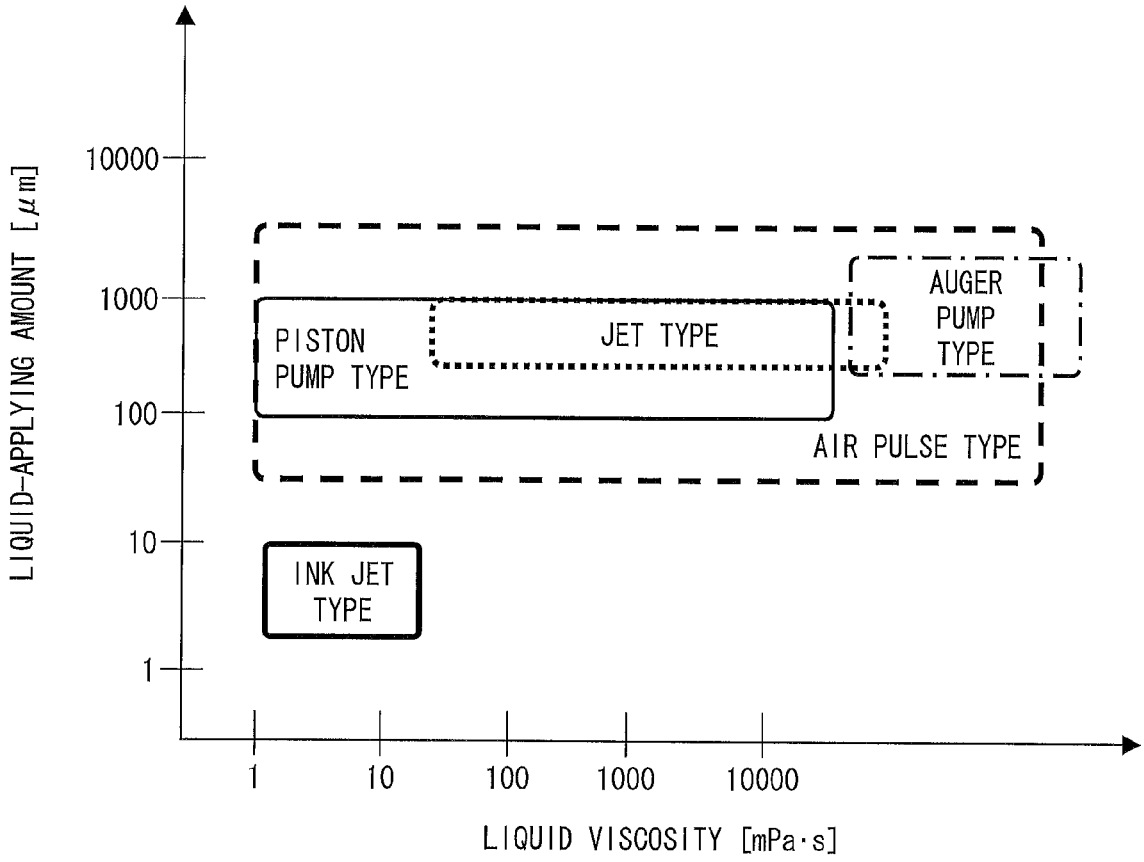
FIG. 4 is a graph illustrating a correlation between a liquid viscosity and a method for discharging the liquid.
Figure 5:
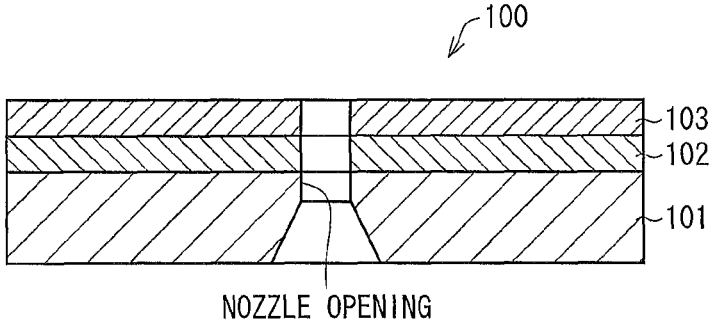
FIG. 5 is a cross-sectional view illustrating a configuration of a conventional liquid discharging nozzle.

The following description will discuss, with reference to FIG. 4, liquid materials to which the liquid discharging nozzle 1 of the present embodiment is applicable. FIG. 4 is a graph illustrating a correlation between a liquid viscosity and a method for discharging the liquid.

As illustrated in FIG. 4, examples of a liquid discharging apparatus, besides ink jets for a small liquid-applying diameter, encompass (i) air pulse type (including valve type), (ii) auger pump type (screw), (iii) piston pump type (plunger), and (iv) jet type, which are for moderate to large liquid-applying diameters.

The following are the descriptions of the respective liquid discharging apparatuses: (i) the air pulse type (including valve type) coordinate liquid pressure with an amount of time for which to discharge liquids, and then discharge a liquid; (ii) the auger pump type (screw) discharge a liquid by a spinning screw; (iii) the piston pump type (plunger) mechanically adjusts the amount of a stroke of a plunger (by measuring the volume of the stroke) so that the viscosity of the liquids are not subject to change; (iv) the jet type discharges (ejects, blasts) a liquid (a) from a distance toward an object and (b) while not in contact with the object.

Note that the liquid discharging nozzle 1 of the present embodiment is applicable to any of the liquid discharging apparatuses above. The liquid discharging nozzle 1 is capable of reducing a resistance to the flow of a liquid by providing the water-repellent layer 5 on the inner surface 20*b* of the discharging tube 20 etc. Therefore, when applied to the jet type that causes rapid flow of a liquid, the liquid discharging nozzle 1 can (i) facilitate the flow of a highly viscous liquid and therefore (ii) lessen the load on the jet type. On the other hand, the liquid discharging nozzle 1 can be applied to the air pulse type (including valve type), auger pump type (screw), and piston pump type (plunger), in a case where a resistance to the flow of a slightly viscous liquid is desired to be reduced even more.

According to the liquid discharging nozzle of the present invention, it is possible to use a resin material as a discharging liquid.

The advantageous effect of the liquid discharging nozzle of the present invention can be highly brought about in a case where the liquid discharging nozzle is used as a medium through which a resin material, which is more viscous than ink, is discharged.

The present invention is not limited to the embodiments, but can be altered in many ways by a person skilled in the art within the scope of the claims. An embodiment derived from a proper combination of technical means disclosed in different embodiments is also encompassed in the technical scope of the present invention.

Industrial Applicability

A liquid discharging nozzle of the present invention can be used (i) as a liquid discharging nozzle for applying a fluorescent material resin for an LED (Light-Emitting Diode) and (ii) for a method for recovering a water-repellent layer of a liquid discharging nozzle.

That is, the liquid discharging nozzle of the present invention (i) is suitable for use in discharging liquids that have high viscosity or surface tension or (ii) can be used in a case where a resistance to the flow of a slightly viscous liquid is desired to be reduced even more.

REFERENCE SIGNS LIST

1 Liquid discharging nozzle
2 Inner and outer surfaces
3 Aluminum oxide ($Al_2O_3$) layer
4 Silicon oxide ($SiO_2$) layer
5 Water-repellent layer
10 Liquid reservoir
10*a* Inner surface of liquid reservoir
11 Cylindrical liquid reservoir
12 Conical liquid reservoir
20 Discharging tube (discharging section)
20*a* Discharging head
20*b* Inner surface of discharging tube

The invention claimed is:

1. A liquid discharging nozzle comprising:
a liquid reservoir for reserving a discharging liquid; and
a discharging section connected to a bottom part of the liquid reservoir,
the discharging section having a discharging head and an inner wall, and the liquid reservoir having an inner wall,
the discharging head of the discharging section, the inner wall of the discharging section, and the inner wall of the liquid reservoir, together having a water-repellent layer provided thereon,
the water-repellent layer being a fluorinated water-repellent layer,
the fluorinated water-repellent layer being provided on a foundation layer in which an aluminum oxide layer and a silicon oxide layer are stacked, the silicon oxide layer being provided on the aluminum oxide layer so as to be in contact with the aluminum oxide layer, and the fluorinated water-repellent layer being provided on the silicon oxide layer so as to be in contact with the silicon oxide layer, and
the aluminum oxide layer, the silicon oxide layer, and the fluorinated water-repellent layer, together having a combined thickness of not more than 25 nm, and the fluorinated water-repellent layer having a thickness of 1 nm to 4 nm.

2. The liquid discharging nozzle as set forth in claim 1, wherein the discharging liquid is a resin material.

3. A method for recovering a water-repellent layer of a liquid discharging nozzle,
said liquid discharging nozzle, comprising:
a liquid reservoir for reserving a discharging liquid; and
a discharging section connected to a bottom part of the liquid reservoir, the discharging section having a discharging head and an inner wall, and the liquid reservoir having an inner wall, the discharging head of the discharging section, the inner wall of the discharging section, and the inner wall of the liquid reservoir, together having the water-repellent layer provided thereon, the water-repellent layer being a fluorinated water-repellent layer, the fluorinated water-repellent layer being provided on a foundation layer in which an aluminum oxide layer and a silicon oxide layer are stacked, the silicon oxide layer being provided on the aluminum oxide layer so as to be in contact with the aluminum oxide layer, and the fluorinated water-repellent layer being provided on the silicon oxide layer so as to be in contact with the silicon oxide layer, and the aluminum oxide layer, the silicon oxide layer, and the fluorinated water-repellent layer, together having a combined thickness of not more than 25 nm, and the fluorinated water-repellent layer having a thickness of 1 nm to 4 nm, said method, comprising the steps of:

(i) removing the water-repellent layer and substances adhered to the water-repellent layer, which removing is carried out by use of at least one of plasma treatment, ultraviolet ray irradiation, and alkaline wash; and (ii) forming a water-repellent layer again after the step (i).

4. A method for recovering a water-repellent layer of a liquid discharging nozzle, said liquid discharging nozzle, comprising:

a liquid reservoir for reserving a discharging liquid; and a discharging section connected to a bottom part of the liquid reservoir, the discharging section having a discharging head and an inner wall, and the liquid reservoir having an inner wall, the discharging head of the discharging section, the inner wall of the discharging section, and the inner wall of the liquid reservoir, together having the water-repellent layer provided thereon, the water-repellent layer being a fluorinated water-repellent layer, the fluorinated water-repellent layer being provided on a foundation layer in which an aluminum oxide layer and a silicon oxide layer are stacked, the silicon oxide layer being provided on the aluminum oxide layer so as to be in contact with the aluminum oxide layer, and the fluorinated water-repellent layer being provided on the silicon oxide layer so as to be in contact with the silicon oxide layer, the aluminum oxide layer, the silicon oxide layer, and the fluorinated water-repellent layer, together having a combined thickness of not more than 25 nm, and the fluorinated water-repellent layer having a thickness of 1 nm to 4 nm, and the discharging liquid being a resin material, said method, comprising the steps of:

(i) removing the water-repellent layer and substances adhered to the water-repellent layer, which removing is carried out by use of at least one of plasma treatment, ultraviolet ray irradiation, and alkaline wash; and (ii) forming a water-repellent layer again after the step (i).

5. The method as set forth in claim 3, wherein:

the step (i) is carried out in such a manner that the water-repellent layer and the substances adhered to the water-repellent layer are removed in a vacuum chamber by use of plasma treatment; and the step (ii) is carried out in such a manner that a water-repellent layer is formed again in the vacuum chamber without exposing the liquid discharging nozzle to the air.

6. The method as set forth in claim 4, wherein:

the step (i) is carried out in such a manner that the water-repellent layer and the substances adhered to the water-repellent layer are removed in a vacuum chamber by use of plasma treatment; and the step (ii) is carried out in such a manner that a water-repellent layer is formed again in the vacuum chamber without exposing the liquid discharging nozzle to the air.

* * * * *